US009028567B2

(12) United States Patent
Rothaemel et al.

(10) Patent No.: US 9,028,567 B2
(45) Date of Patent: May 12, 2015

(54) METHOD AND APPARATUS FOR PRODUCING SYNTHETIC FUELS

(75) Inventors: Martin Rothaemel, Frankfurt am Main (DE); Theis Ohlhaver, Frankfurt am Main (DE); Peter Trabold, Darmstadt (DE); Andreas Ochs, Friedrichsdorf (DE); Harald Koempel, Neu-Isenburg (DE)

(73) Assignee: Lurgi GmbH, Frankfurt am Main (DE)

( * ) Notice: Subject to any disclaimer, the term of this patent is extended or adjusted under 35 U.S.C. 154(b) by 577 days.

(21) Appl. No.: 13/381,235

(22) PCT Filed: Jul. 3, 2010

(86) PCT No.: PCT/EP2010/004032

§ 371 (c)(1), (2), (4) Date: Dec. 28, 2011

(87) PCT Pub. No.: WO2011/006594

PCT Pub. Date: Jan. 20, 2011

(65) Prior Publication Data

US 2012/0102829 A1 May 3, 2012

(30) Foreign Application Priority Data

Jul. 14, 2009 (DE) ..... 10 2009 032 915

(51) Int. Cl.

| | |
|---|---|
| ***C10L 1/18*** | (2006.01) |
| ***C10G 29/22*** | (2006.01) |
| *C10L 1/185* | (2006.01) |

(52) U.S. Cl.

CPC ..... *C10G 29/22* (2013.01); *C10L 1/185* (2013.01); *C10L 2290/60* (2013.01);

(Continued)

(58) Field of Classification Search

CPC ... C10L 1/185; C10L 1/1852; C10L 2290/60; C10L 2290/543; C10L 2300/30; C10G 29/22; C10G 2400/22

USPC ..... 44/447

See application file for complete search history.

(56) References Cited

U.S. PATENT DOCUMENTS

| | | | |
|---|---|---|---|
| 3,482,952 | A | 12/1969 | Sieg et al. |
| 3,902,870 | A | 9/1975 | Rollmann et al. |

(Continued)

FOREIGN PATENT DOCUMENTS

| | | |
|---|---|---|
| CA | 2228738 | 8/1999 |
| CN | 1127242 | 7/1996 |

(Continued)

OTHER PUBLICATIONS

PCT Notification Concerning Transmittal of International Preliminary Report on Patentability, from International Application No. PCT/EP2010/004032, corresponding to U.S. Appl. No. 13/381,235, mailed Jan. 26, 2012, pp. 1-12.

*Primary Examiner* — Cephia D Toomer

(74) *Attorney, Agent, or Firm* — Pauly, Devries Smith & Deffner, LLC

(57) ABSTRACT

For producing synthetic fuels, an educt mixture containing steam and oxygenates, such as methanol and/or dimethyl ether, is converted to olefins on a catalyst in a first process stage, and this olefin mixture then is divided in a separating means into a stream rich in $C_1$-$C_4$ hydrocarbons and a stream rich in $C_{5+}$ hydrocarbons. The stream rich in $C_{5+}$ hydrocarbons is divided into a stream rich in $C_5$ and $C_6$ hydrocarbons and a stream rich in $C_{7+}$ hydrocarbons, wherein the stream rich in $C_5$ and $C_6$ hydrocarbons is at least partly subjected to an etherification with methanol. The ethers thus obtained are admixed to the gasoline product stream.

8 Claims, 1 Drawing Sheet

(52) U.S. Cl.
CPC ..... *C10L 2290/543* (2013.01); *C10L 1/1852* (2013.01); *C10L 2270/023* (2013.01); *C10L 2300/30* (2013.01); *C10L 2290/58* (2013.01); *C10G 2300/4081* (2013.01); *C10G 2400/20* (2013.01); *C10G 2400/22* (2013.01)

(56) References Cited

U.S. PATENT DOCUMENTS

| | | | | | |
|---|---|---|---|---|---|
| 4,025,572 | A | * | 5/1977 | Lago | 585/408 |
| 4,198,530 | A | | 4/1980 | Wentzheimer et al. | |
| 4,684,757 | A | | 8/1987 | Avidan et al. | |
| 4,788,365 | A | * | 11/1988 | Harandi et al. | 585/312 |
| 5,024,679 | A | * | 6/1991 | Harandi et al. | 44/449 |
| 5,130,101 | A | | 7/1992 | Harandi et al. | |
| 5,243,090 | A | * | 9/1993 | Haag et al. | 568/697 |

FOREIGN PATENT DOCUMENTS

| | | |
|---|---|---|
| DE | 10027159 | 12/2001 |
| DE | 10346532 | 5/2005 |
| EP | 0254496 | 1/1988 |
| EP | 0320158 | 6/1989 |
| EP | 0432163 | 6/1991 |
| EP | 0490571 | 6/1992 |
| EP | 0320180 | 4/1993 |
| EP | 0882692 | 12/1998 |

* cited by examiner

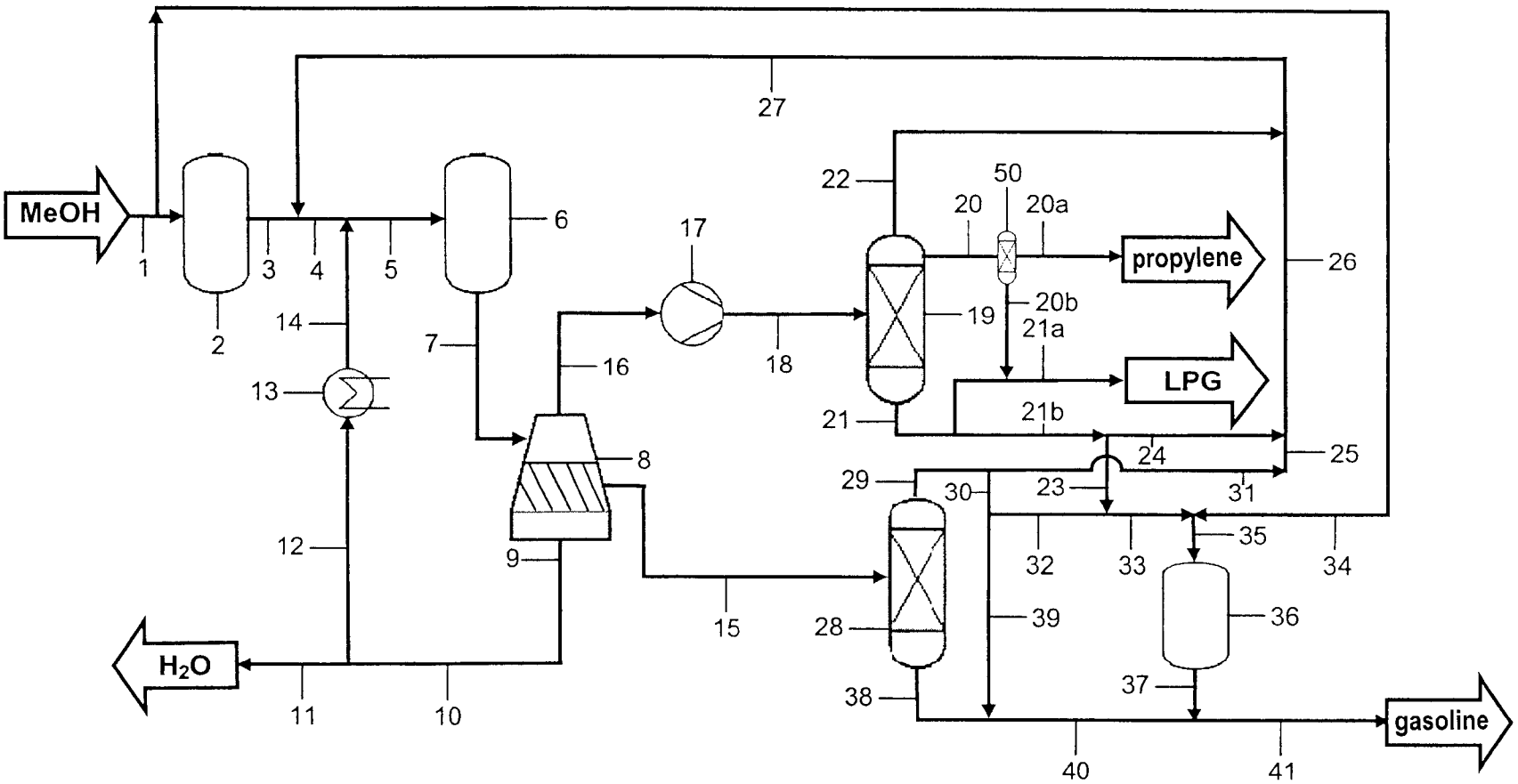
MeOH
propylene
LPG
gasoline
$H_2O$
1
2
3
4
5
6
7
8
9
10
11
12
13
14
15
16
17
18
19
20
20a
20b
21
21a
21b
22
23
24
25
26
27
28
29
30
31
32
33
34
35
36
37
38
39
40
41
50

METHOD AND APPARATUS FOR PRODUCING SYNTHETIC FUELS

CROSS-REFERENCE TO RELATED APPLICATIONS

This application is a national stage application under 35 U.S.C. 371 of International Patent Application Serial No. PCT/EP2010/004032, entitled "METHOD AND APPARATUS FOR PRODUCING SYNTHETIC FUELS," filed Jun. 3, 2010, which claims priority from German Patent Application No. 10 2009 032 915.3, filed Jul. 14, 2009.

FIELD OF THE INVENTION

This invention relates to a process and a plant for producing synthetic fuels from an educt mixture containing steam and oxygenates, such as methanol and/or dimethyl ether (DME).

BACKGROUND

For producing low-molecular $C_2$-$C_4$ olefins, in particular propylene, from methanol and/or dimethyl ether (Methanol to Propylene, MTP), a multitude of processes are known to the skilled person, which usually are based on the conversion of an educt mixture containing steam as well as methanol and/or dimethyl ether vapor on a form-selective zeolite catalyst. Such processes are described for example in DE 100 27 159 A1 or EP 0 882 692 B1.

The methanol mostly is introduced into an adiabatically operated prereactor, where it is converted to dimethyl ether (DME) and water ($H_2O$) by using a highly active and highly selective $Al_2O_3$ catalyst. The methanol/water/DME stream is passed to the first one of a plurality of reactor stages, into which the vapor produced is supplied as well. In this reactor stage, an almost complete conversion of both methanol and dimethyl ether occurs, with propylene chiefly being obtained as hydrocarbon product. Further conversions can be achieved in subsequent reactor stages. In all stages, the process conditions are chosen such that similar reaction conditions and a maximum propylene yield are ensured. Thus, a yield of propylene of more than 60% is obtained, and in addition further olefin fractions above all, but also a gasoline fraction are obtained.

The gasoline product resulting from such a plant is of high value. Typical values as compared with the indicated European specifications according to EN 228 for regular gasoline reveal the high value of the product:

| Property | Achieved property | EN 228 (regular gasoline) |
|---|---|---|
| Octane number (ROZ, RON) | 93-95 | >91 |
| Sulfur content | <detection limit | <50 mg/kg |
| Aromatics content | 15-20 vol-% | <35 vol-% |
| Benzene content | <0.25 vol-% | <1 vol-% |

However, the direct use of this gasoline at the gasoline station still is not possible, since the olefin content lies above the limit value of maximally 18 vol-% valid in Europe.

From the prior art, a number of solution possibilities for this problem are known, by means of which the olefin content can be reduced.

SUMMARY OF THE INVENTION

Therefore, it is the object of the invention to achieve a lowering of the olefin content in synthetic fuels and thus produce a saleable product. The formation of environmentally problematic byproducts should be reduced, wherein additional and non-process substances should rather be omitted.

This object substantially is solved with the invention in that in a process for producing synthetic fuels in a first process stage an educt mixture containing steam and oxygenates, such as methanol and/or dimethyl ether, is converted to olefins on a catalyst, this olefin mixture is separated in a separating means into a stream rich in $C_1$-$C_4$ hydrocarbons and a stream rich in $C_{5+}$ hydrocarbons, the stream rich in $C_{5+}$ hydrocarbons is divided into a stream rich in $C_5$ and $C_6$ hydrocarbons (pentene, hexene) and a stream rich in $C_{7+}$ hydrocarbons, the stream rich in $C_5$ and $C_6$ hydrocarbons is at least partly subjected to an etherification with methanol, and the ethers thus obtained are admixed to the gasoline product stream rich in $C_{7+}$ hydrocarbons.

By etherification with methanol, methyl amyl ether is obtained from the pentene fraction, and methyl hexyl ether is obtained from the hexene fraction. Other than with a partial discharge of the olefins after a separation, the quantity of the valuable product thus is not reduced. At the same time the olefin content is lowered, whereby the legal limit value can be maintained.

Due to the formation of high-octane ethers, the octane number also remains constant. The $C_5$ and $C_6$ olefins contained in the gasoline fractions have octane numbers of 110-145, paraffins which possibly also are obtained by an additional hydrogenation lead to octane numbers of 85-100, and the methyl ethers obtained by etherification have octane numbers of 115-125, with these octane numbers each having to be understood as blending octane numbers, so-called BONs.

It is also advantageous that due to the preceding process steps a methanol supply is present and no further substances must be introduced into the process. By separating the olefins it can also be achieved that the likewise generated LPG only has a low olefin content as well.

In accordance with a preferred embodiment of the invention, a partial stream of the stream rich in $C_5$ and $C_6$ hydrocarbons is guided past the etherification and directly admixed to the gasoline product stream rich in $C_{7+}$ hydrocarbons.

It was found to be advantageous to control the division between the $C_5/C_6$ stream supplied to the etherification and the $C_5/C_6$ stream guided past the etherification in dependence on the total olefin content of the resulting gasoline product. The higher the olefin content in the gasoline product, the larger the fraction of the $C_5/C_6$ stream supplied to the etherification, wherein both streams can vary between 0 and 100%. Even with a variable composition of the individual mass flows, a gasoline product whose properties correspond to the legal limit values thus can be produced continuously.

In accordance with a development of the invention, the $C_4$ fraction is separated from the stream rich in $C_1$-$C_4$ hydrocarbons and at least partly subjected to the etherification with methanol. By an at least partial etherification of the butene fraction, the quantity of the valuable product can further be increased by complying with the specifications. From the butene fraction, methyl tertiary butyl ether (MTBE) is obtained. A $C_4$ partial stream always is present in an MTP plant, so that no additional costs are incurred.

For adjusting the vapor pressure, a $C_4$ partial stream is admixed to the gasoline product if necessary in accordance with the invention.

Another embodiment of the invention includes the fact that at least parts of the pentene and hexene fraction are recirculated to the reactor of the first process stage, which additionally increases the flexibility of the process in terms of the product spectrum.

By a selective hydrogenation upstream of the olefin etherification, the amount of disturbing compounds (e.g. dienes) which render an etherification more difficult and/or lead to undesired byproducts can be lowered in accordance with the invention.

It is favorable to carry out the etherification by a standardized process, preferably by an ion exchanger. For the process, temperatures of 50 to 90° C. and a pressure of 1 to 1.5 MPa are particularly preferred, since all components then are present in liquid form.

The invention furthermore relates to a plant for producing synthetic fuels, which is suitable for carrying out the process according to the invention. This plant comprises a reactor for the catalytic conversion of an educt mixture containing steam and oxygenates, such as methanol and/or dimethyl ether, to olefins, a first separating means for dividing the olefin mixture into a stream rich in $C_1$-$C_4$ hydrocarbons and a stream rich in $C_{5+}$ hydrocarbons, a further separating means for branching off a stream rich in $C_5$ and $C_6$ hydrocarbons from the stream rich in $C_{5+}$ hydrocarbons, and a reactor for the etherification of the $C_5$ fraction and the $C_6$ fraction with methanol.

Preferably, butene additionally is supplied to the etherification reactor via a supply conduit. Thus, the olefin content of the resulting gasoline can be lowered further and the butene can be utilized in a value-increasing manner.

Another design of the plant according to the invention provides a conduit for the at least partial recirculation of the pentene and hexene fractions from the further separating means to the olefin-generating reactor. The flexibility in terms of the product spectrum generated with this plant can further be increased thereby.

To remove compounds which render an etherification more difficult or lead to undesired byproducts during the etherification, a reactor for the selective hydrogenation of these compounds is provided in one design of the plant, which reactor is provided upstream of the reactor for etherification.

In accordance with the invention, the etherification reactor is an ion exchanger, whereby an established and thus risk-minimized component is employed.

As separating means for dividing the olefin mixture into the $C_1$-$C_4$ stream and the stream rich in $C_{5+}$ hydrocarbons a cooler preferably is employed, whereby other than in a chemical separation process the introduction of additional substances can be omitted.

For separating the pentene and hexene fractions from those fractions with seven and more carbon atoms a distillation column preferably is used, which has the necessary separation sharpness for this separation task.

Further developments, advantages and possible applications of the invention can also be taken from the following description and the drawing. All features described and/or illustrated form the subject-matter of the invention per se or in any combination, independent of their inclusion in the claims or their back-reference.

BRIEF DESCRIPTION OF THE FIGURES

FIG. 1 schematically shows a plant for performing the process in accordance with the invention.

DETAILED DESCRIPTION

Admixing the raw gasoline to a gasoline produced in some other way, for example from a refinery, is conceivable when the same has complementary product properties, i.e. for example a high sulfur and/or aromatics content. In the resulting mixed fraction product properties of both partial streams thus can be utilized, in order to mutually relativize each other. For example by admixing the synthetic raw gasoline, the sulfur and aromatics content of the resulting total stream can be lowered, while at the same time the olefin content falls below the legal limit value due to the admixture of refinery gasoline. What is disadvantageous here, however, is the high logistic effort for carrying out such admixture or the necessity of producing both gasoline partial streams in local proximity for economic reasons.

A separation of the olefins, e.g. via an extraction, involves a high technical expenditure and is not very selective, whereby beside the olefins the non-disturbing high-octane aromatics also are removed from the end product. Furthermore, the hydrogenation of the olefins to paraffins would be a fundamental possibility for lowering the olefin content, which in addition can easily be realized in technical terms. Due to the increased paraffin content, however, the octane number drops by 5-7 points, so that even the limit value of regular gasoline (RON>91) can no longer be maintained.

By means of a dimerization of the short-chain olefin fractions before the hydrogenation this disadvantage can be limited. However, since the mass related olefin content remains constant, the adducts must be hydrogenated, whereby the octane number is decreased and the boiling curve becomes worse.

Preserving the high octane number of the synthetic raw gasoline can be achieved by alkylation, for example of i-butane with butenes. As a result, the olefin content is decreased by simultaneously forming high-octane paraffinic adducts. However, the highly acid catalyst (e.g. sulfuric acid, hydrogen fluoride) necessary for such reaction at the same time promotes a number of side reactions with other constituents of the raw gasoline. Therefore, an expensive and unprofitable separation of the fraction to be alkylated, such as the $C_4$ fraction, would have to be carried out before the conversion.

What is most promising therefore is the conversion of these olefins with alcohols to high-octane components. Such synthesis, in particular for producing methyl tertiary butyl ether (MTBE) has been known in the literature for many years. A fundamental description of this process can be found for example in Ullmann's Encyclopedia of Industrial Chemistry, 6th Edition, 1998. Reference should also be made to the U.S. Pat. No. 4,198,530.

In connection with the etherification of olefins for the purpose of lowering the olefin content in gasolines while at the same time preserving the octane number, U.S. Pat. No. 4,361,422 teaches a process for treating an olefinic $C_5$ fraction by controlled hydrogenation and subsequent etherification with a $C_1$-$C_4$ alcohol. The patent specification U.S. Pat. No. 3,902,870 reports on lowering the bromine number of cracking gasolines correlated with the olefin content by means of olefin etherification with methanol. From U.S. Pat. No. 3,482,952 there is also known a process for producing a high-octane gasoline while at the same time lowering the volatility and the atmospheric reactivity by etherification of the tertiary olefins with lower alcohols in the presence of an etherification catalyst.

In all these processes it is, however, disadvantageous that additional substances, namely the alcohols each necessary for etherification, must be introduced into the process.

Another problem relates to the limitation of the olefin fractions in terms of chain length. CA 22 28 738 for example teaches a process for producing light olefins by combining the process steps steam reforming, oxygenate production and conversion of the oxygenates to olefins, wherein the propylene and butylene obtained in the last-mentioned step is converted into high-octane products by means of etherification, after first having been separated from the product mixture.

Further documents, such as EP 0 320 180 B1 or EP 0 432 163 A1 describe processes for combining a methanol-to-olefin process with a subsequent etherification of the olefins, but here the oxygenate conversion always takes place subsequent to the etherification. During the formation of oxygenates this leads to additional byproducts, which subsequently must be removed from the process.

In the plant shown in FIG. 1, methanol is fed into a DME reactor 2 as educt through conduit 1 and in said reactor is at least partly converted to dimethyl ether on an $Al_2O_3$ catalyst. The methanol/DME mixture subsequently is passed through conduit 3 and conduit 4, mixed with the steam originating from conduit 14 and finally fed through conduit 5 into the reactor 6 in which it is catalytically converted to hydrocarbons, in particular to propylene (MTP). Conduit 7 passes the product mixture into a first separating means designed as cooler 8, in which the olefin fractions are divided into a stream rich in $C_1$-$C_4$ hydrocarbons and a stream rich in $C_{5+}$ hydrocarbons. Furthermore, water is obtained there as byproduct of the reaction. The cooler 8 thus is a three-phase separating means (liquid/liquid/gaseous).

The $C_1$-$C_4$ fractions are guided via conduit 16 into the compressor 17 and through conduit 18 to a second separating means 19 which consists of at least one distillation column. Via conduit 20*a* stream rich in propylene is supplied to a further separating means 50 in which a stream rich in propane is separated. The stream rich in propylene is discharged via conduit 20*a*. Via conduit 21 the separated $C_4$ fraction leaves the separating means 19. First, a part of the stream is discharged via conduit 21*a* together with the propane from conduit 20*b* as liquefied gas (LPG). This liquefied gas chiefly consisting of propane and butane with an only small olefin content can be used e.g. as autogas. The main part of the stream 21 is transferred via conduits 21*b* and 24 into conduit 26, into which the fraction rich in ethylene, which preferably is withdrawn over the head of the separating means 19, also is transferred with conduit 22. By means of conduit 27 the stream can then be recirculated into the conduit 4 before the reactor 6.

At the same time, water is withdrawn from the cooler 8 via conduit 9 and those olefin fractions which are rich in components with a chain length of five or more carbon atoms ($C_{5+}$ stream) are withdrawn via conduit 15. By means of conduits 10 and 11 the water chiefly obtained by the conversion of methanol and DME is discharged from the process, wherein a partial stream of the water can be supplied to an evaporator 13 via conduit 12 and can then be introduced into the reactor 6 as steam via conduits 14 and 5.

Via conduit 15, the $C_{5+}$ stream flows into a further, third separating means 28 in which a stream rich in $C_{7+}$ hydrocarbons is separated and withdrawn from the process through the conduits 38, 40 and 41.

The $C_5$ fraction and the $C_6$ fraction ($C_5/C_6$ fraction) are withdrawn from the third separating means 28 via conduit 29. By means of conduits 31 and 25 this fraction can at least partly be fed into conduit 26 and be recirculated to the reactor 6 combined with the ethylene and butylene fractions.

At least a partial quantity of the $C_5/C_6$ fraction from conduit 29 is transferred into conduit 30. From there, the stream divided further can wholly or partly be admixed to the higher-value olefins from conduit 38 through conduit 39 and thus be withdrawn from the process, wherein the ratio of the mass flows in conduit 39 to those in conduit 30 can lie between 0 and 100%.

The remaining partial stream (100-0%) of the $C_5/C_6$ fraction is guided via conduits 33 and 35 into an etherification reactor 36 formed for example as ion exchanger. Into the supply conduit 35 or also directly into the reactor 36, methanol is supplied via conduit 34, which for example has been branched off from the supply conduit 1 before the DME reactor 2. By means of the methanol, the olefins are etherified in the reactor 36 to obtain methyl amyl ether or methyl hexyl ether. Via conduit 37, these ethers then can be admixed to the fractions with seven or more carbon atoms from conduit 40 and the gasoline product thus increased in value can be withdrawn via conduit 41. Through conduit 23 butene from the second separating means 19 can also be supplied to the etherification.

Ideally, only the $C_4$ and $C_5/C_6$ streams are subjected to the etherification, since under the etherification conditions the $C_{7+}$ stream rich in aromatics might be subjected to side reactions.

In a non-illustrated manner, a selective hydrogenation can be provided upstream of the etherification reactor 36, in order to remove disturbing compounds, such as dienes.

The distribution of the pentene and hexene fractions on conduits 32 and 39 is controlled in dependence on the olefin content of the gasoline product in conduit 41. The higher the olefin content, the larger the fraction of the $C_5/C_6$ stream which is guided over the etherification, since the olefin content thereby can be lowered.

With the invention it thus is possible to lower the olefin content in the gasoline product, so that the specified limit values can be complied with. At the same time, the quantity of the gasoline meeting the specification is increased due to the conversion. Due to the resulting high-octane ethers, the octane number remains constant or even is increased. Since the methanol and the $C_4$ partial stream anyway are present in an MTP plant, no additional costs are incurred.

The effect of the partial etherification according to the invention of a partial stream of the MTP gasoline for the purpose of lowering the olefin content is illustrated in the following calculation examples. There are each indicated relative quantities. In addition, the increase in volume of the product due to the addition of methanol is taken into account, wherein it has been assumed for simplification that half of the olefin content in the $C_5/C_6$ stream each is distributed on pentenes and hexenes. EF is the etherification fraction, i.e. the ratio of mass flow 32/mass flow 30.

Example 1

| | C7+ | Etherification fraction(EF) C5/C6 | | 0% | MeOH | Prod | Gasoline | |
|---|---|---|---|---|---|---|---|---|
| Stream No. | 38 | 30 | 39 | 32 | 34 | 37 | | 41 |
| Quantity, rel. | 67% | 33% | 33% | 0% | 0% | 0% | 100% | 100% |
| Olefins, wt-% | 20% | 50% | 50% | 0% | 0% | 0% | 30% | 30% |

| | C7+ | Etherification fraction (EF) C5/C6 | | 33% | MeOH | Prod | Gasoline | |
|---|---|---|---|---|---|---|---|---|
| Stream No. | 38 | 30 | 39 | 32 | 34 | 37 | | 41 |
| Quantity, rel. | 67% | 33% | 22% | 11% | 2% | 13% | 102% | 100% |
| Olefins, wt-% | 20% | 50% | 50% | 0% | 0% | 0% | 25% | 24% |

| | C7+ | Etherification fraction (EF) C5/C6 | | 66% | MeOH | Prod | Gasoline | |
|---|---|---|---|---|---|---|---|---|
| Stream No. | 38 | 30 | 39 | 32 | 34 | 37 | | 41 |
| Quantity, rel. | 67% | 33% | 11% | 22% | 5% | 27% | 105% | 100% |
| Olefins, wt-% | 20% | 50% | 50% | 0% | 0% | 0% | 19% | 18% |

| | C7+ | Etherification fraction (EF) C5/C6 | | 100% | MeOH | Prod | Gasoline | |
|---|---|---|---|---|---|---|---|---|
| Stream No. | 38 | 30 | 39 | 32 | 34 | 37 | | 41 |
| Quantity, rel. | 67% | 33% | 0% | 33% | 7% | 40% | 107% | 100% |
| Olefins, wt-% | 20% | 50% | 50% | 0% | 0% | 0% | 13% | 12% |

The mass flows and olefin contents of the streams 38 and 30 are obtained from the test operation. In the above example, an untreated gasoline product 41 would have an olefin content of 30%, which exceeds the allowed 18% according to Euro Specification. In accordance with the invention, about 66% of the stream 30 will be supplied to the etherification, in order to finally achieve 18% in the product.

Example 2

| | C7+ | Etherification fraction(EF) C5/C6 | | 0% | MeOH | Prod | Gasoline | |
|---|---|---|---|---|---|---|---|---|
| Stream No. | 38 | 30 | 39 | 32 | 34 | 37 | | 41 |
| Quantity, rel. | 67% | 33% | 33% | 0% | 0% | 0% | 100% | 100% |
| Olefins, wt-% | 14% | 40% | 40% | 0% | 0% | 0% | 23% | 23% |

| | C7+ | Etherification (EF) C5/C6 | | 33% | MeOH | Prod | Gasoline | |
|---|---|---|---|---|---|---|---|---|
| Stream No. | 38 | 30 | 39 | 32 | 34 | 37 | | 41 |
| Quantity, rel. | 67% | 33% | 22% | 11% | 2% | 13% | 102% | 100% |
| Olefins, wt-% | 14% | 40% | 40% | 0% | 0% | 0% | 18% | 18% |

| | C7+ | Etherification fraction (EF) C5/C6 | | 66% | MeOH | Prod | Gasoline | |
|---|---|---|---|---|---|---|---|---|
| Stream No. | 38 | 30 | 39 | 32 | 34 | 37 | | 41 |
| Quantity, rel. | 67% | 33% | 11% | 22% | 4% | 26% | 104% | 100% |
| Olefins, wt-% | 14% | 40% | 40% | 0% | 0% | 0% | 14% | 13% |

-continued

| | C7+ | Etherification fraction (EF) C5/C6 | | 100% | MeOH | Prod | Gasoline | |
|---|---|---|---|---|---|---|---|---|
| Stream No. | 38 | 30 | 39 | 32 | 34 | 37 | | 41 |
| Quantity, rel. | 67% | 33% | 0% | 33% | 6% | 39% | 106% | 100% |
| Olefins, wt-% | 14% | 40% | 40% | 0% | 0% | 0% | 9% | 9% |

If the olefin content of the streams 38 and 30 changes within the process, e.g. due to ageing of the catalyst or changed reaction conditions, a new operating point will be obtained for the etherification fraction. In the above example, the olefin content in the output streams has decreased, so that the operator of a plant can reduce the etherification fraction to 33%, and 18% nevertheless are not exceeded in the gasoline product.

LIST OF REFERENCE NUMERALS

1 conduit
2 DME reactor
3-5 conduit
6 MTP reactor
7 conduit
8 first separating means (cooler)
9-12 conduit
13 evaporator
14-16 conduit
17 compressor
18 conduit
19 second separating means
20-27 conduit
28 third separating means
29-35 conduit
36 etherification reactor
37-41 conduit
50 separating means

The invention claimed is:

1. A process for producing synthetic fuels, comprising converting an educt mixture containing steam and oxygenates to an olefin mixture on a catalyst in a first process stage, dividing the olefin mixture in a separating means into a stream rich in $C_1$-$C_4$ hydrocarbons and a stream rich in $C_{5+}$ hydrocarbons, dividing the stream rich in $C_{5+}$ hydrocarbons into a stream rich in $C_5$ and $C_6$ hydrocarbons and a stream rich in $C_{7+}$ hydrocarbons, subjecting the stream rich in $C_5$ and $C_6$ hydrocarbons at least partially to an etherification with methanol to form ethers admixing the ethers thus obtained with a gasoline product stream rich in C7+ hydrocarbons, and wherein a partial stream of the stream rich in $C_5$ and $C_6$ hydrocarbons is guided past the etherification and admixed directly to the gasoline product stream.

2. The process according to claim 1, wherein the fraction of the $C_5/C_6$ stream supplied to the etherification and the fraction of $C_5/C_6$ stream guided past the etherification is controlled in dependence on the total olefin content of the gasoline product obtained.

3. The process according to claim 1, wherein a $C_4$ fraction is separated from the stream rich in $C_1$-$C_4$ hydrocarbons and at least partly subjected to the etherification with methanol.

4. The process according to claim 1, wherein a $C_4$ fraction is separated from the stream rich in $C_1$-$C_4$ hydrocarbons and that the $C_4$ fraction is admixed to the gasoline product stream.

5. The process according to claim 1, wherein the stream rich in $C_5$ and $C_6$ hydrocarbons is partly recirculated to the first process stage.

6. The process according to claim 1, wherein a selective hydrogenation is provided upstream of the etherification.

7. The process according to claim 1, wherein the etherification is carried out by means of an ion exchanger.

8. The process according to claim 1, wherein the etherification is carried out at a temperature of 50 to 90° C. and a pressure of 1 to 1.5 MPa.

* * * * *